United States Patent [19]

Jenkins et al.

[11] Patent Number: 4,707,251

[45] Date of Patent: Nov. 17, 1987

[54] CONTAINER SCANNING AND ACCOUNTING DEVICE

[75] Inventors: Jerry V. Jenkins; Haskell F. Sloan, both of Denver; Robert L. Frenkel, Englewood, all of Colo.; Albert Zielinski, Buffalo, N.Y.

[73] Assignee: Golden Aluminum Company, Lakewood, Colo.

[21] Appl. No.: 746,866

[22] Filed: Jun. 20, 1985

[51] Int. Cl.[4] ..... B07C 5/344

[52] U.S. Cl. ..... 209/569; 198/416; 209/523; 209/583; 209/701; 356/428; 267/139

[58] Field of Search ..... 209/523, 524, 528, 583, 209/538, 539, 540, 545, 701, 931, 917, 267, 569; 198/445, 446, 447, 451, 452, 415, 416, 394; 194/4 C, 212, 213, 205; 267/158, 139; 293/1, 102; 356/426, 428; 235/475

[56] References Cited

U.S. PATENT DOCUMENTS

| | | | |
|---|---|---|---|
| 1,214,519 | 2/1917 | Demuth | 209/701 |
| 1,409,462 | 3/1922 | Naterman | 293/124 |
| 2,889,165 | 6/1959 | Zientara | 293/1 |
| 3,232,429 | 2/1966 | Norwich | 209/539 |
| 3,746,165 | 7/1973 | Ford et al. | 209/524 |
| 3,752,293 | 8/1973 | Fort | 198/448 |
| 3,866,739 | 2/1975 | Sikorski | 198/415 |
| 3,901,381 | 8/1975 | Quinn | 209/701 |
| 4,019,620 | 4/1977 | Frenkel et al. | 198/451 |
| 4,029,958 | 6/1977 | Wright | 209/587 |
| 4,158,624 | 6/1979 | Ford et al. | 209/656 |
| 4,248,389 | 2/1981 | Thompson et al. | 209/524 |

FOREIGN PATENT DOCUMENTS

| | | | |
|---|---|---|---|
| 0128438 | 7/1984 | Japan | 356/428 |
| 2005885 | 4/1979 | United Kingdom | 209/524 |

*Primary Examiner*—Robert B. Reeves
*Assistant Examiner*—Donald T. Hajec
*Attorney, Agent, or Firm*—Sheridan, Ross & McIntosh

[57] ABSTRACT

An apparatus is provided to rapidly and automatically scan the UPC, or bar code, from a series of containers and maintain talleys of the brands and types of containers processed. A guide is placed diagonally across the top of the conveyor to catch and direct any containers moving along the conveyor. Continued motion of the conveyor beneath the containers at an angle relative to the guide causes each container to rotate as it slides along the guide toward the edge of the conveyor. One or more UPC scanners are positioned to read the UPC from each container as it slides along the guide. Because of the rotation of the containers, the entire sidewall of each container is exposed to the scanners. Any containers that are not successfully read by the scanners are rejected for subsequent manual processing.

13 Claims, 3 Drawing Figures

CONTAINER SCANNING AND ACCOUNTING DEVICE

BACKGROUND OF THE INVENTION

This invention pertains generally to the field of recycling used beverage containers. In particular, the present invention is a system for rapidly scanning large numbers of containers and maintaining talleys of the numbers, brands, and types of containers scanned.

In recent years, several states have enacted mandatory deposit legislation for beverage containers. In these states, grocery stores and other retail outlets are primarily responsible for redeeming used beverage containers returned by consumers. In some situations, the retailer sorts the containers by brand or type. However, in many situations, retailers simply accumulate unsorted containers in bags or boxes. The containers are picked up on a regular basis from retailers by a clearing house. The clearing house sorts and/or counts the containers by brand, so that the appropriate bottlers or distributors can be invoiced for deposits returned by each retailer to consumers. Traditional manual sorting and counting techniques used by clearing houses are relatively slow and costly.

UPC scanners have gained wide acceptance in grocery stores where they are used at checkout counters to read the UPC, or bar code, from items purchased by consumers. Industry standards have been adopted, and a unique UPC is assigned to each product. Like other food packages, each brand and type of beverage container has been assigned a unique UPC. Although this coding system was originally designed for use in the context of expediting the checkout process in grocery stores, this technology has also been found to be applicable in recycling used beverage containers.

For example, U.S. Pat. No. 4,248,384 discloses a general system using a UPC scanner to read the codes from used beverage containers. The code on each container is then used to direct the container to one of a number of different outfeed conveyors for re-use, reclamation, or disposal. One principal problem associated with using a UPC scanner for this purpose has been attaining a satisfactorily high processing rate. The scanner used in the preferred embodiment has a field of view consisting of a line a few inches in length. Thus, the problem is to provide a means for rapidly feeding containers through the field of view of the scanner, one at a time and at a controlled rate. The situation is further complicated by the fact that each container must be rotated while in the field of view of the scanner to allow the scanner to view the entire circumference of the container to locate the UPC. This combined problem of rapidly transporting a series of containers into the view of the scanner while rotating each container, is difficult to solve without introducing needless complexity. With existing systems of this general type, each container is individually staged in front of the scanner by an indexing mechanism, and then rotated by a separate mechanism. For example, U.S. Pat. No. 4,248,389 (Column 2, lines 48, et seq.) mentions that a turntable can be used to rotate the container before the scanner. Alternatively, a roller positioned under the container can be employed to spin the container (Column 4, lines 14 et seq.). However, arrangements of this type require a transport or indexing mechanism to load each container to and from the turntable or roller. Other types of mechanisms used to rotate containers are discussed generally in U.S. Pat. Nos. 3,991,883; 4,029,958; 3,532,215; and 4,497,409. In contrast, the present invention accomplishes an elegant simplicity of design by using a diagonal guide mounted over a declining conveyor belt to both rotate the containers and move them through the path of the scanner. The conveyor moving past under the guide causes the containers to spin as they slide along the guide. One or more scanners are directed at the lower end of the guide so as to read the UPC from each container as its slides and rotates along the edge of the guide. Those containers whose UPC's have been successfully read by at least one of the scanners are allowed to drop off the edge of the conveyor into a bin or onto another conveyor for densification or re-use in the case of reusable containers. Those containers that cannot be read are diverted into a separate bin for later manual processing. The combination of a diagonal guide and conveyor to simultaneously transport and rotate the containers under the scanner constitute a substantial improvement over the prior art in terms of speed, cost, and dependability.

SUMMARY OF THE INVENTION

The present invention provides an apparatus for reading the UPC, or bar code, from used beverage containers. The UPC scanners communicate with a computer to maintain an accounting of the number of each type and brand of containers processed. More specifically, the unsorted containers redeemed by a particular grocery store or collection center are loaded into a hopper that discharges into a vibratory feeder. Baffles and guide channels on the feeder are used to direct the containers into a uniform end-to-end orientation onto an in-feed conveyor. One or more controlled gates may be used to accumulate the containers on the in-feed conveyor, and regulate the timing to release each lane of containers to be read by the scanners. The containers are released onto a second declining conveyor that has a higher belt speed than the in-feed conveyor. This difference in belt speeds between the conveyors results in increased physical spacing between containers on the second conveyor to insure that only one container at a time is within the field of view of the scanners. A guide is mounted diagonally across the top of this second conveyor. One or more scanners are mounted above the conveyor to view the area of the conveyor directly in front of the lower end of the guide near the edge of the conveyor. As containers move down the conveyor, they come in contact with the guide. Because the conveyor passes beneath the guide at an angle with respect to the guide, the conveyor causes the containers to simultaneously spin and slide along the guide toward the edge of the conveyor. The UPC's are read as containers slide through the field of view of the scanners. The information read by the scanners is transmitted to a computer for accounting purposes. In this manner, appropriate reimbursements can be made by each bottler, manufacturer, or distributor for deposits refunded by each retailer to consumers for containers.

One purpose of this invention is to provide a fast and reliable automated system for identifying and tabulating the brands and types of used beverage containers in place of the manual sorting techniques heretofore predominantly used in deposit states. This provides the substantial additional advantage of greatly reducing costs associated with recycling beverage containers. The present invention also requires far less space than manual sorting.

BRIEF DESCRIPTION OF THE DRAWINGS

The present invention will be better understood by reference to the accompanying drawings, in which.

DETAILED DESCRIPTION OF THE INVENTION

Figure 1:
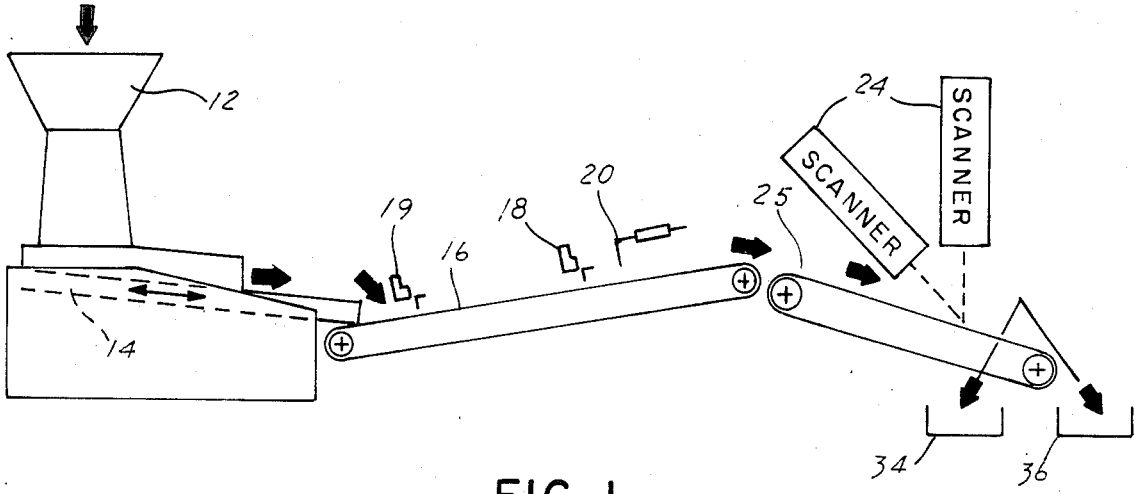
FIG. 1 is a schematic side view of the entire apparatus showing the hopper, vibratory feeder, in-feed conveyor, control gates, and scanning section as shown in greater detail in FIGS. 2 and 3.

Turning to FIG. 1, a schematic side view of the entire apparatus is shown. Containers are fed into an in-feed hopper 12 and fall on to a vibratory feeder 14 where the containers are directed into a uniform end-to-end orientation by means of a series of guides and baffles. The containers are transferred to an in-feed conveyor 16 having a number of parallel lanes and gates 20 for accumulating containers.

Figure 2:
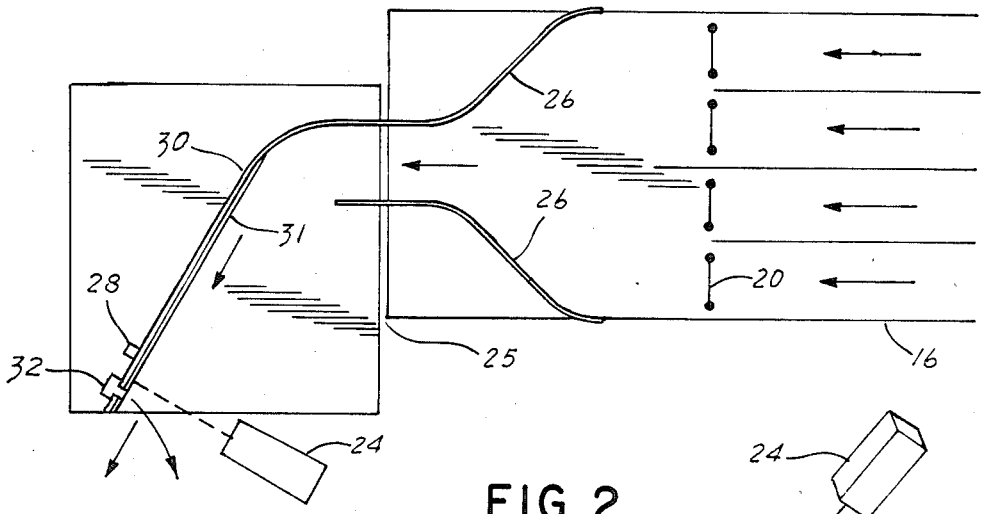
FIG. 2 is a schematic top view showing the path of the containers on the latter portion of the in-feed conveyor, beginning with the control gates and accumulating lanes, and continuing through the scanning section of the apparatus.
Figure 3:
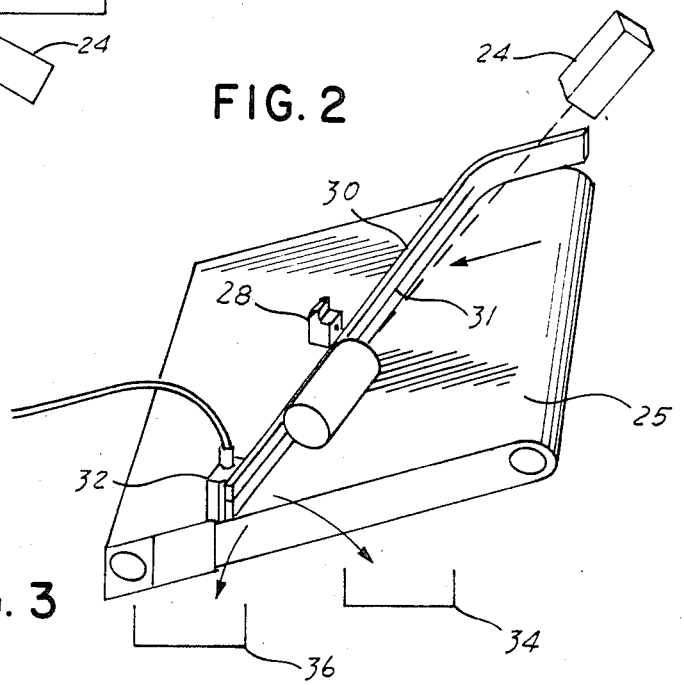
FIG. 3 is a perspective view of the scanning section of the apparatus shown in FIG. 2.

Each lane has two photo eyes 18 and 19 to detect the presence of a container at the entrance to the lane, and behind the control gate 20 at the end of the lane. These gates and the accumulating lanes are shown more clearly in FIG. 2. The gates are activated at the control of a computer that also processes the information generated by the UPC scanners 24. In this manner, the computer can regulate the timing and sequence with which containers are released by each lane for scanning. The computer normally activates the gate for each lane in sequence. However, in the event the photo eye 18 at the end of a lane indicates that no containers are waiting, the computer may be programmed to skip that lane in the sequence. The photo eyes 19 at the entrance to each lane are used to sense when a lane is full and should be given priority over other lanes. When two or more of the lanes are full, the vibratory feeder is temporarily shut down to allow the accumulator lanes to empty. FIG. 2 shows a schematic top view of the latter section of the system, beginning with the accumulator lanes and gates.

Each container released by the gates moves along the in-feed conveyor toward a second conveyor 25 for scanning. This scanning conveyor has a slight decline, and moves with a greater belt speed than the in-feed conveyor. This results in increased spacing between containers to insure that only one container is within the field of view of the scanners at any given time.

The scanning conveyor is located at a lateral offset with respect to the in-feed conveyor. Guides 26 at the end of the in-feed conveyor funnel the containers released by the gates toward the center of the in-feed conveyor. Because of the lateral offset, containers are fed from the in-feed conveyor onto the scanning conveyor near its edge opposite the field of view of the scanners. More specifically, the containers are directed toward the leading edge of the diagonal guide 30. The diagonal guide 30 can either be a bar, wall, or wire provided it allows the conveyor to pass freely beneath it, and yet guides the containers moving on the conveyor. In the preferred embodiment, a wire 31 is strung in front of the guide to act as a bumper. Use of a wire bumper offers greatly reduced friction as well as increased stability of the containers as they rotate and slide along the diagonal guide.

Containers released by the gates tend to continue down the conveyor in an end-to-end orientation. The containers are guided along the contour of the diagonal guide 30. The motion of the conveyor beneath the container at an angle with respect to the axis of the container causes the container to simultaneously rotate about its axis, and slide along the diagonal guide toward the edge of the conveyor. The relative translational and rotational velocities of the container may be adjusted by changing the conveyor's speed, and the angle of the diagonal guide with respect to the conveyor. For example, as the guide is adjusted to be more perpendicular to the motion of the conveyor, the ratio of translational to rotational motion of the container is decreased. Conversely, if the guide is more parallel to the motion of the conveyor, the ratio of translational to rotational motion is increased.

A photo eye 28 is used to detect the presence of a container at a predetermined location along the diagonal guide. One or more UPC scanners 24 are directed toward the front face of the guide in the vicinity of this predetermined location. Because the scanners have a very narrow field of view, containers sliding along the guide are only within the field of view of the scanners for a few inches. In order to insure the entire surface of the wall of the container is visible to the scanners, the container must complete at least one complete rotation while within this field of view and be presented to the scanner for a minimum period of time. This is achieved by proper selection of scanners, conveyor speed and angle of the diagonal bar as discussed above.

The photo eye 28 signals the computer that a container has moved along the guide into the field of view of the scanners. If at least one of the scanners succeeds in reading a valid UPC from the container, the computer updates its talleys and allows the container to continue sliding along the guide and off the edge of the conveyor onto a conveyor or bin 34 for subsequent densification, re-use or disposal. The information read by each of the scanners 24 is output to a computer for processing. The computer maintains talleys for each batch of the types and brands of containers processed. In turn, this information can be used to invoice the appropriate bottler, or distributor, for refunds paid by each retailer to consumers, and also charge each retailer the appropriate handling fee.

Otherwise, if none of the scanners reads a valid UPC while the container is within the scanners' field of view, the computer will then activate an ejector means 32 to divert the container into a second chute or bin 36 for subsequent manual processing. In the preferred embodiment, the ejector means is simply an air jet located along the edge of the conveyor on the diagonal guide. When activated by the computer, the jet releases a high velocity stream of air that blows the container and off the edge of the conveyor into a second conveyor or bin 36. The rejected containers are subsequently processed by hand.

We claim:

1. An apparatus for scanning containers, said containers each having a code and each having a longitudinal axis, comprising:

(a) A conveyor for transporting said containers, said conveyor moving in a first direction at a predetermined speed;

(b) A guide diagonally mounted across the top of at least a portion of the conveyor at a predetermined angle relative to said first direction of said conveyor, wherein each of said containers contemporaneously moves along said guide and rotates about its own said longitudinal axis, and wherein said predetermined speed and said predetermined angle are established so that each container will complete at least one revolution within a predetermined distance along said guide; and (c) scanner means for scanning said code on each of said containers, said scanner means having an orientation and a field of view wherein said predetermined distance along said guide is scannable by said scanning means.

2. The apparatus of claims 1 wherein the guide comprises a bar having a wire bumper along its front face.

3. The apparatus of claim 1 further comprising gates controlling the sequence at which containers are released down the conveyor.

4. The apparatus of claim 1 further comprising an ejector means for rejecting any containers that are not successfully scanned by at least one of the scanners.

5. The apparatus of claim 4, wherein the ejector means comprise a jet of air that may be activated to reject containers.

6. The apparatus of claim 1, wherein said conveyor is declining in said first direction.

7. An apparatus for scanning containers, said containers each having a code and each having a longitudinal axis, comprising:

(a) Conveyor means for transporting said containers in a first direction at a predetermined speed;

(b) Means for directing the containers into a uniform orientation on the conveyor means;

(c) A number of parallel lanes on said conveyor means, the release of containers from which is controlled by a gate;

(d) A guide mounted diagonally across the top of at least a portion of the conveyor means at a predetermined angle relative to said first direction of said containers, wherein each of said containers contemporaneously moves along said guide and rotates about its own said longitudinal axis, and wherein said predetermined speed and said predetermined angle are established so that each container will complete at least one revolution within a predetermined distance along said guide;

(e) scanner means for scanning said code on each of said containers, said scanner means having an orientation and a field of view wherein said predetermined distance along said guide is scannable by said scanning means.

8. The apparatus of claim 7, wherein said means for directing containers into a uniform orientation on the conveyor means comprises a vibratory feeder and a number of guides.

9. The apparatus of claim 7, further comprising ejector means for rejecting any container having a code not successfully scanned by said scanner.

10. The apparatus of claim 7, wherein said conveyor means comprises an in-feed conveyor, having a first belt speed, and a scanning conveyor, having a second belt speed, wherein said means for directing containers and said parallel lanes are positioned over said in-feed conveyor, and wherein said guide is mounted over said scanning conveyor.

11. The apparatus of claim 10, wherein said second belt speed is greater than said first belt speed.

12. The apparatus of claim 10, wherein said in-feed conveyor and said scanning conveyor are laterally offset.

13. The apparatus of claim 10, wherein said scanning conveyor is declining with respect to said in-feed conveyor.

* * * * *